US006006811A

United States Patent [19]

Brutsaert

[11] Patent Number: 6,006,811

[45] Date of Patent: Dec. 28, 1999

[54] VERANDA TENT

[75] Inventor: Lieven Brutsaert, Menen, Belgium

[73] Assignee: Whitehall, naamioze vennootschap., Menen, Belgium

[21] Appl. No.: 08/964,387

[22] Filed: Nov. 6, 1997

[30] Foreign Application Priority Data

Nov. 12, 1996 [BE] Belgium ..... 09600951
Mar. 26, 1997 [BE] Belgium ..... 09700268

[51] Int. Cl.[6] ..... E04H 15/58

[52] U.S. Cl. ..... 160/71; 160/80; 135/141; 135/903; 135/88.12

[58] Field of Search ..... 160/66, 68, 71, 160/80; 242/919; 135/88.1, 88.12, 141, 156, 157, 903, 907

[56] References Cited

U.S. PATENT DOCUMENTS

Re. 30,664 7/1981 Upton et al. ..... 135/88.12 X
2,079,073 5/1937 Knoll .
3,918,510 11/1975 Hayward ..... 135/88.12 X
3,923,074 12/1975 McKee ..... 135/88.12 X
4,188,964 2/1980 Greer ..... 135/903 X
5,340,187 8/1994 Haddad ..... 160/71 X
5,562,143 10/1996 Oberstadt .

*Primary Examiner*—Robert Canfield
*Attorney, Agent, or Firm*—Bacon & Thomas PLLC

[57] ABSTRACT

Improved veranda tent of the type whereby the winding and unwinding mechanism is provided in a top casing (2) and whereby the deployment lath (8) of the tent cloth (3) can be moved in guides, characterized in that the aforementioned guides each are formed by two parts, namely fixed guides (4–5) and movable guides (6–7), whereby these movable guides (6–7) are movable in lengthwise direction in respect to the fixed guides (4–5) and whereby the movable guides (6–7) are movable in respect to the deployment lath (8).

24 Claims, 7 Drawing Sheets

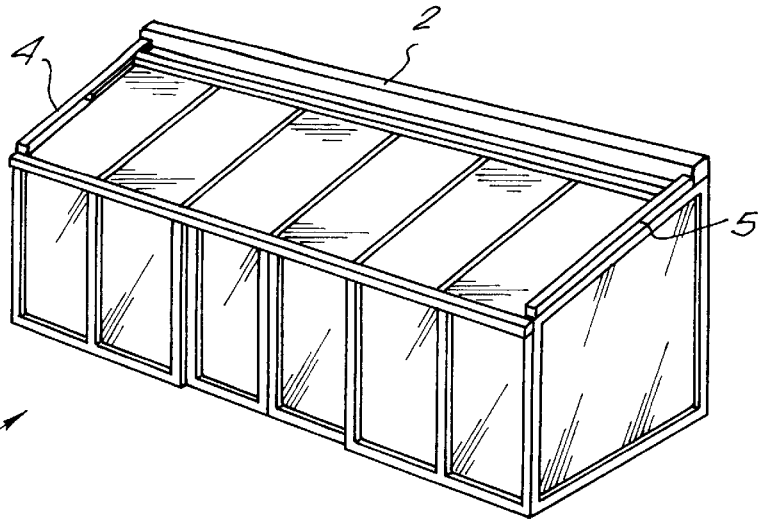
Fig.1
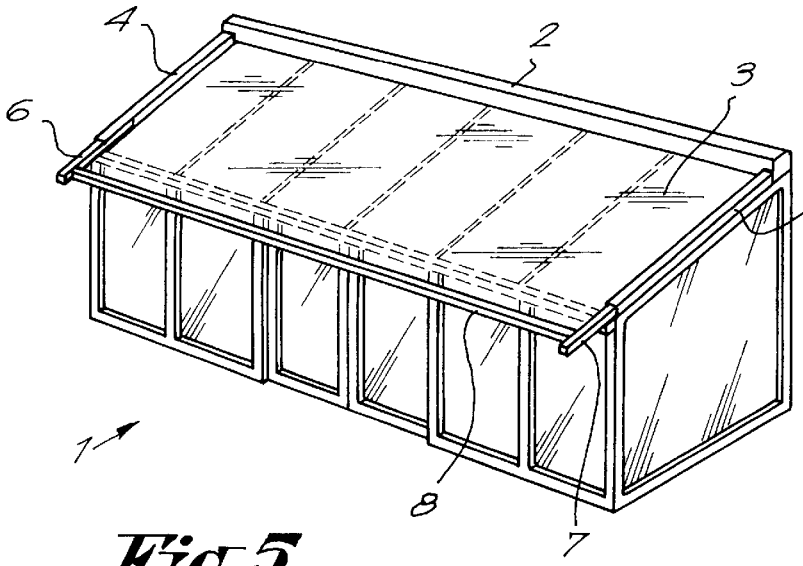
Fig.2
Fig.5
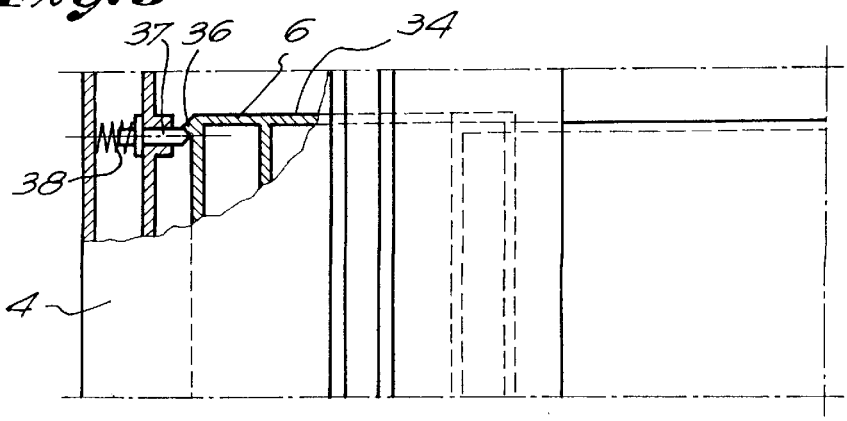

9
2
10
P2
P1
28
26
6
27
4
12
P
34
16
17
24
35
25

4
6
18
33
8
24
28
12
12
19
32

4
14
6
18
12
32
8
16
22
20
12
15
19
33

4
6
26
12
33
8
14
15
12
19
32

4
27
18
33
32
8
14
15
12
19
6

4
18
35
32
8
14
15
25
12
19
6

11
13
24
16
23
17
26
7
27
35
28
34
20
22
21
5
25
9
3
30
31
2
29
8
12
10
6
4
F13

VERANDA TENT

BACKGROUND OF THE INVENTION

1. Field of the Invention

This invention relates to an improved veranda tent, more particularly a veranda tent of the type used as a sunshade at the exterior side, substantially the upper side, of a veranda or the like.

2. Description of the Related Art

It is known that the most efficient sunshade is formed by a tent cloth in any material which is provided alongside the exterior side above the roof of the veranda.

Such veranda tent, anyhow, may also be used in itself, in other words, as an actual tent.

The guides for such a veranda tent almost always have a length which is equal to the depth of the veranda, in such a manner that the tent cloth, when it is completely unwound, covers the complete upper surface of the veranda.

In order to still reduce the incidence of light, it has already been proposed to have the aforementioned guides protrude over the lower edge of the veranda roof in order to obtain thereby that the tent cloth, when it is completely unwound, protrudes over the lower edge of the veranda roof.

The disadvantage of such a construction, anyhow, is that, when the tent cloth is wound up, the aforementioned guides always keep protruding over the lower edge of the veranda roof which is no esthetic sight, on one hand, and which often forms a danger if the height of the veranda is relatively small, on the other hand.

SUMMARY OF THE INVENTION

The present invention aims at an improved veranda tent which allows to unwind the roll of cloth past the lower edge of the roof pane of the veranda but whereby, when the tent cloth is wound up, no protruding parts are present under the roof edge of the veranda cloth.

To this aim, the improved veranda tent showing the aforementioned and other advantages consists of a winding and unwinding mechanism provided in a top casing and whereby the deployment lath of the tent cloth can be moved in guides, characterized in that the aforementioned guides each are formed of two parts, namely fixed guides and movable guides, whereby these movable guides are movable in lengthwise direction in respect to the fixed guides and whereby the movable guides can be moved from the deployment lath.

In an advantageous form of embodiment, the fixed guides will be constructed as exterior guide, whereas the movable guides are constructed as interior guide. In another form of embodiment, the movable guides, respectively interior guides, may be realized in a telescopic manner.

BRIEF DESCRIPTION OF THE DRAWINGS

With the intention of better showing the characteristics of the invention, preferred embodiments of an improved veranda tent according to the invention are described hereafter, by way of example, without any limitative character, with reference to the accompanying drawings, wherein:

FIG. 1, in a very schematic manner, in perspective represents a veranda provided with an improved veranda tent according to the invention, whereby the tent cloth is in wound-up position;

FIG. 2 is a view similar to that of FIG. 1, whereby, however, the tent cloth is in unwound position;

FIG. 5, on a larger scale, represents the part which is indicated by F5 in FIG. 3;

DETAILED DESCRIPTION OF THE PREFERRED EMBODIMENTS

Figure 3:
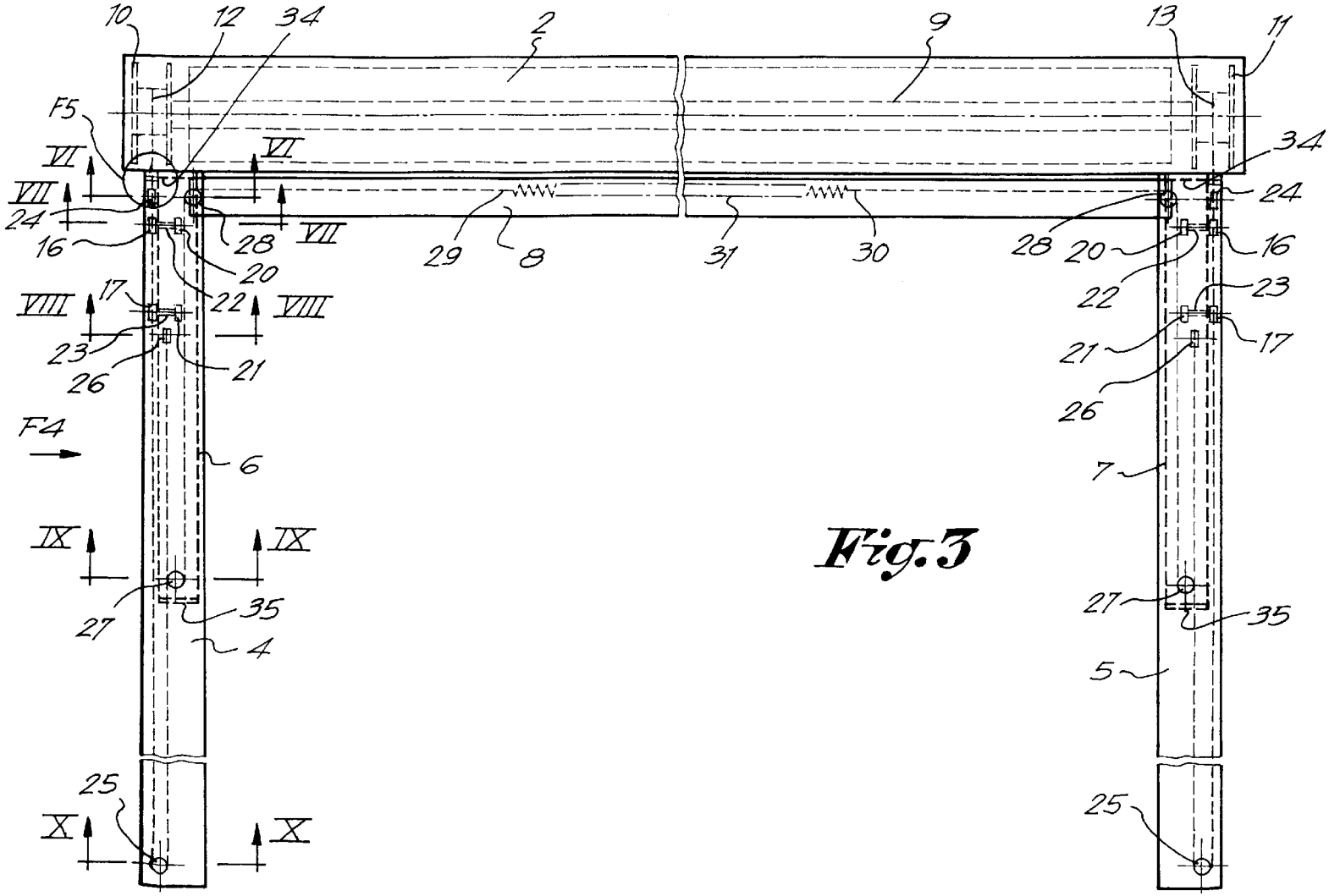
FIG. 3 represents a top view of the veranda tent according to the invention.

In FIGS. 1 and 2, a veranda 1 is represented above which an improved veranda tent according to the invention is provided.

This veranda tent substantially consists in a top casing 2 wherein the winding mechanism for the tent cloth 3 is situated, and, towards each extremity of this top casing 2, exterior guides, 4 and 5, respectively, extending over the complete depth of the veranda 1, in other words, from the top casing 2 up to the lower edge of the roof pane.

These exterior guides 4–5 consist of a substantially U-shaped profile, the open sides of which are directed towards each other.

With these exterior guides 4 and 5 cooperate interior guides, 6 and 7, respectively, in which latter the extremities of the deployment lath 8, to which the tent cloth 3 is attached, can be moved.

These interior guides 6–7 substantially show a T-shape which is rotated 90°.

The complete driving mechanism for the tent cloth 3 is situated in the top casing 2, whereby this driving mechanism substantially is formed by a shaft 9 to which the second extremity of the tent cloth is attached and upon which this latter can be wound; a not represented electric motor which, for example, can be provided in the shaft 9 in order to wind and unwind the tent cloth 3; and at each extremity of the shaft 9 a reel, 10 and 11, respectively, at which one extremity of a cable, 12 and 13, respectively, is fixed.

The exterior guides 4 and 5, over almost the largest part of their length, show rails, 14 and 15, respectively, on one hand, which may serve as guides for rollers 16, and rolling surfaces 18–19, respectively, for guide wheels 20 and 21, whereby the rollers 16 and 17 each are mounted on a shaft 22 and 23, whereupon, in this form of embodiment, the guide wheels 20 and 21 are fixed, too.

The rollers 16 and 17 show a diabolo-shape, in such a way that they do not only form a vertical, but also a lateral guide, whereas the guide wheels 20 and 21 are simple flat rollers.

The shafts 22 and 23 are attached in the respective interior guides 6 and 7, whereby the wheels 16–17 and 20–21 are attached in an appropriate manner freely rotatable, but axially immobile, at the shafts 22 and 23.

Starting from the pair of reels 10 and 11, the pair of cables 12 and 13 run over a plurality of pulleys 24, 25, 26, 27 and 28, and subsequently disappear in the deployment lath 8 wherein the extremity 29 of cable 12, by the intermediate of a tension spring 31 is connected to the extremity 30 of cable 13.

The aforementioned pulleys 24 to 28 are always fixed freely rotatable, but axially immobile, on shafts which, as becomes clear from the FIGS. 6 to 10, themselves are fixed in an appropriate manner, respectively in the exterior guides 4–5, the interior guides 6–7 and the deployment profile 8, in such a manner that the cables 12 and 13 can pass freely through these exterior guides 4–5, respectively interior guides 6–7.

The second and fourth pulleys 25 and 27 are provided at the lower free extremity of the exterior guides 4–5, respectively the interior guides 6–7, whereas the third pulleys 26 are provided at a distance from the lower free extremity of the interior guides 6–7 which is somewhat larger than the length of the interior guides 6–7 which desirably extends beyond the exterior guides 4–5.

Towards each extremity, the deployment lath 8 is provided with a protrusion 32 situated in a space 33 in the interior guides 6 and 7, whereby the interior guides 6 and 7, towards each extremity, at least at the location of the space 33, are closed by means of a wall, 34 and 35, respectively, which, in this form of embodiment, forms an abutment for the aforementioned protrusions 32 of the deployment lath 8.

Obviously, such an abutment might also be formed by a pin or pin-like structure.

Finally, at the outer wall of each interior guide 6–7, more particularly towards the upper free extremity thereof, a protrusion 36 is provided which, for example, is triangular, whereas towards the upper extremity of each exterior guide 4 and 5 a pin 37 is provided in this latter with which the aforementioned protrusion 36 can cooperate, the free extremity of which preferably is triangular, too.

The pin 37, under the influence of a pressure spring 38, is always pushed towards the interior guide 6 or 7 concerned.

The functioning of the veranda tent according to the invention is very simple and as follows.

In the position whereby the tent cloth 3 is wound up, the deployment lath 8 is situated with its protrusions 32 against the abutments 34 of the interior guides 6 and 7, whereby these interior guides 6–7 also are situated in their uppermost position, more particularly the position as shown in FIG. 5, whereby the protrusions 36 are situated behind the pins 37 of the guides 4–5.

Figure 4:
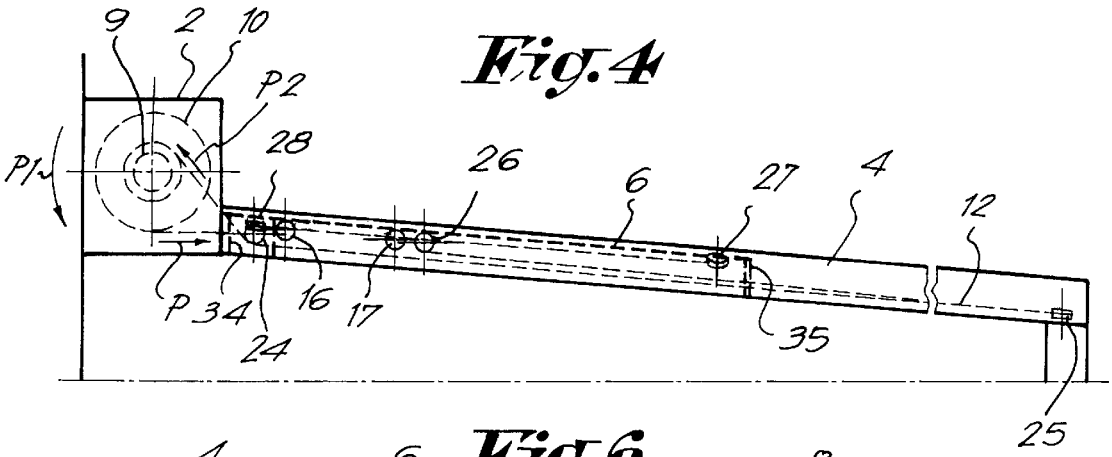
FIG. 4 represents a view according to arrow F4 in FIG. 3.
Figure 6:
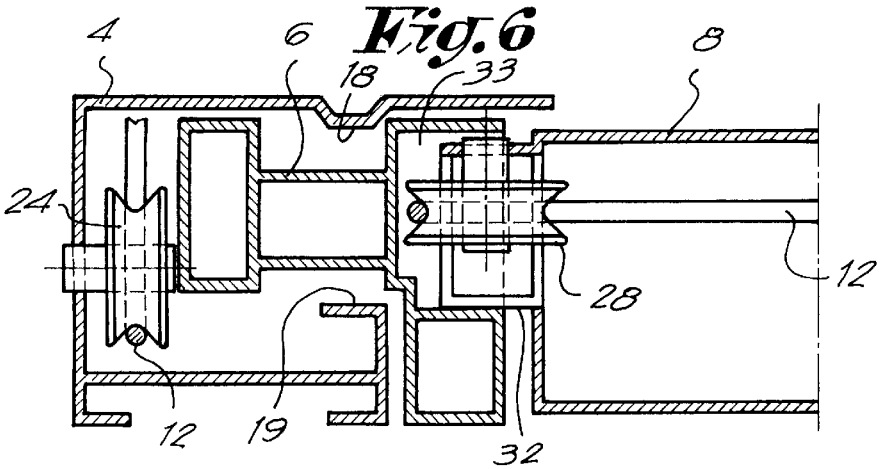
FIGS. 6, 7, 8, 9 and 10, on a larger scale, represent cross-sections according to the lines VI—VI, VII—VII, VIII—VIII, IX—IX and X—X in FIG. 3.
Figure 7:
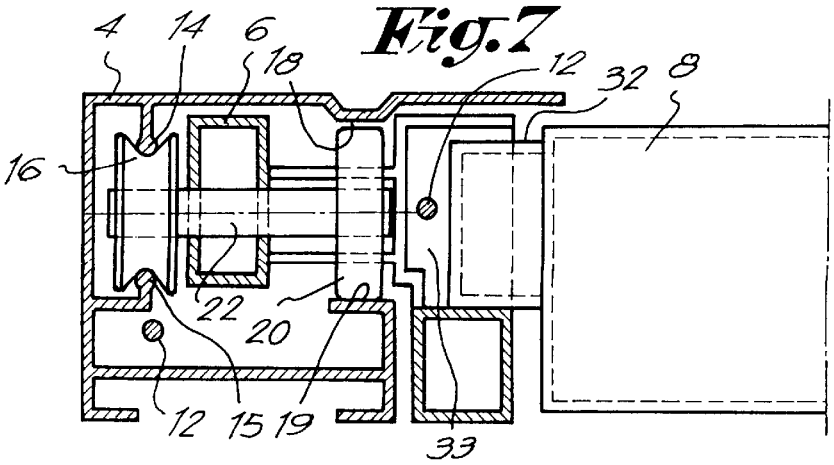
Figure 8:
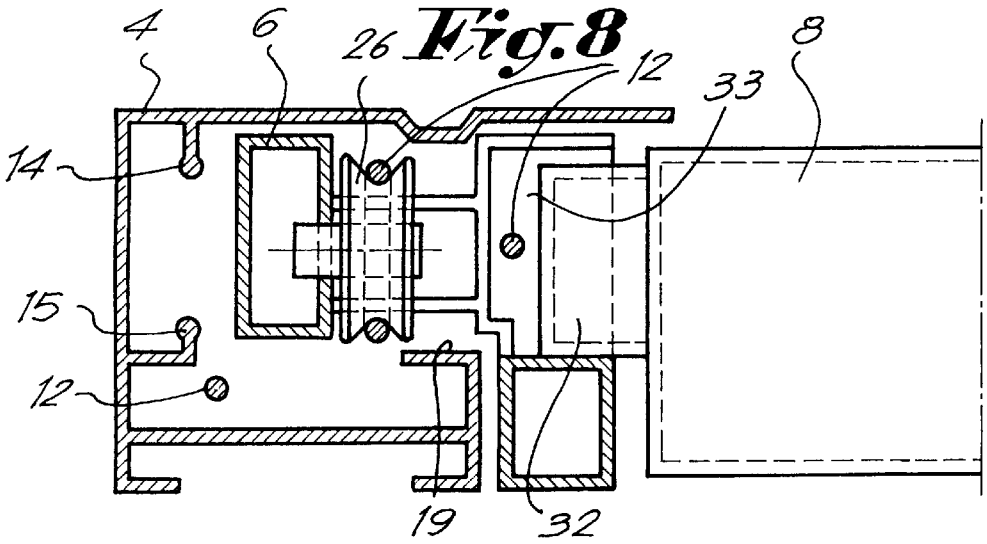
Figure 9:
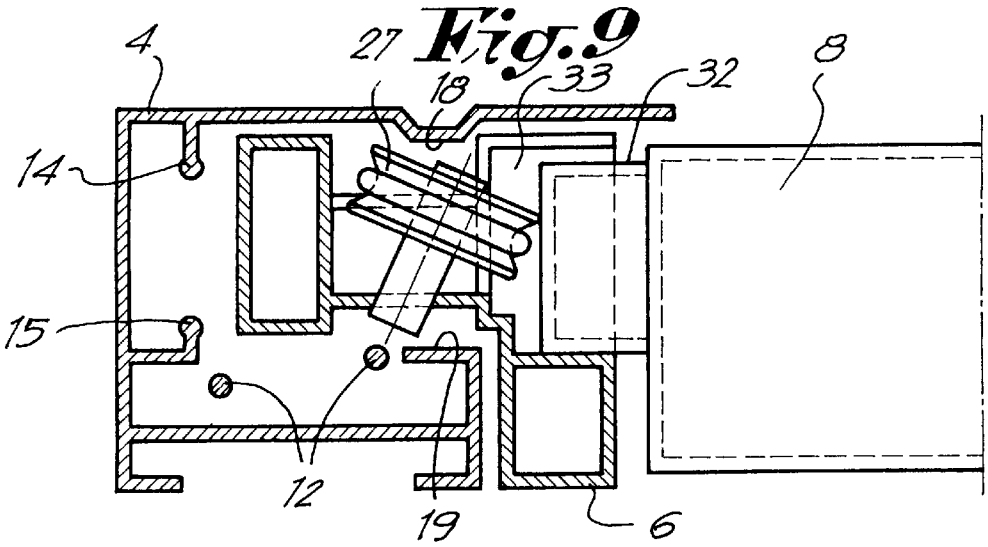
Figure 10:
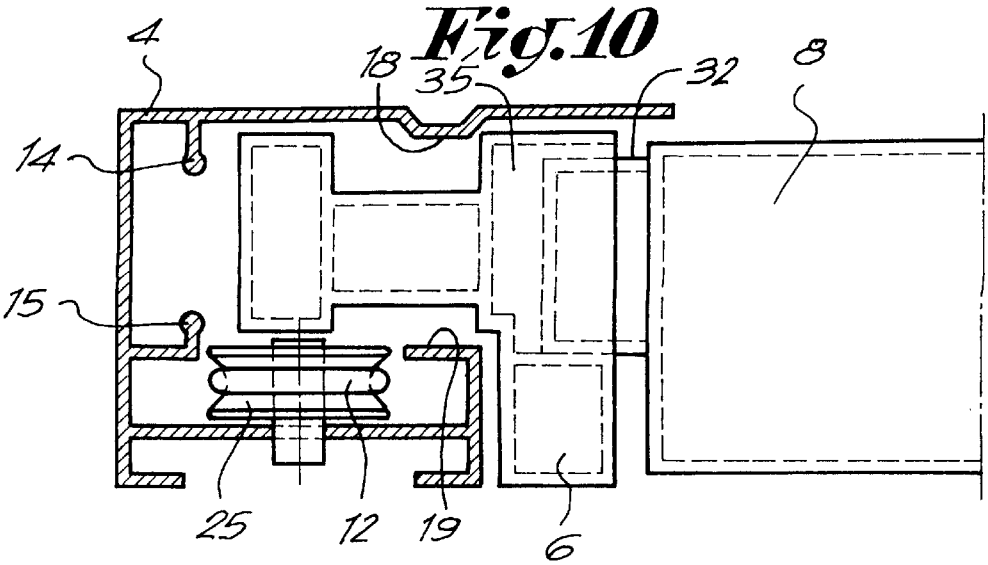
Figure 11:
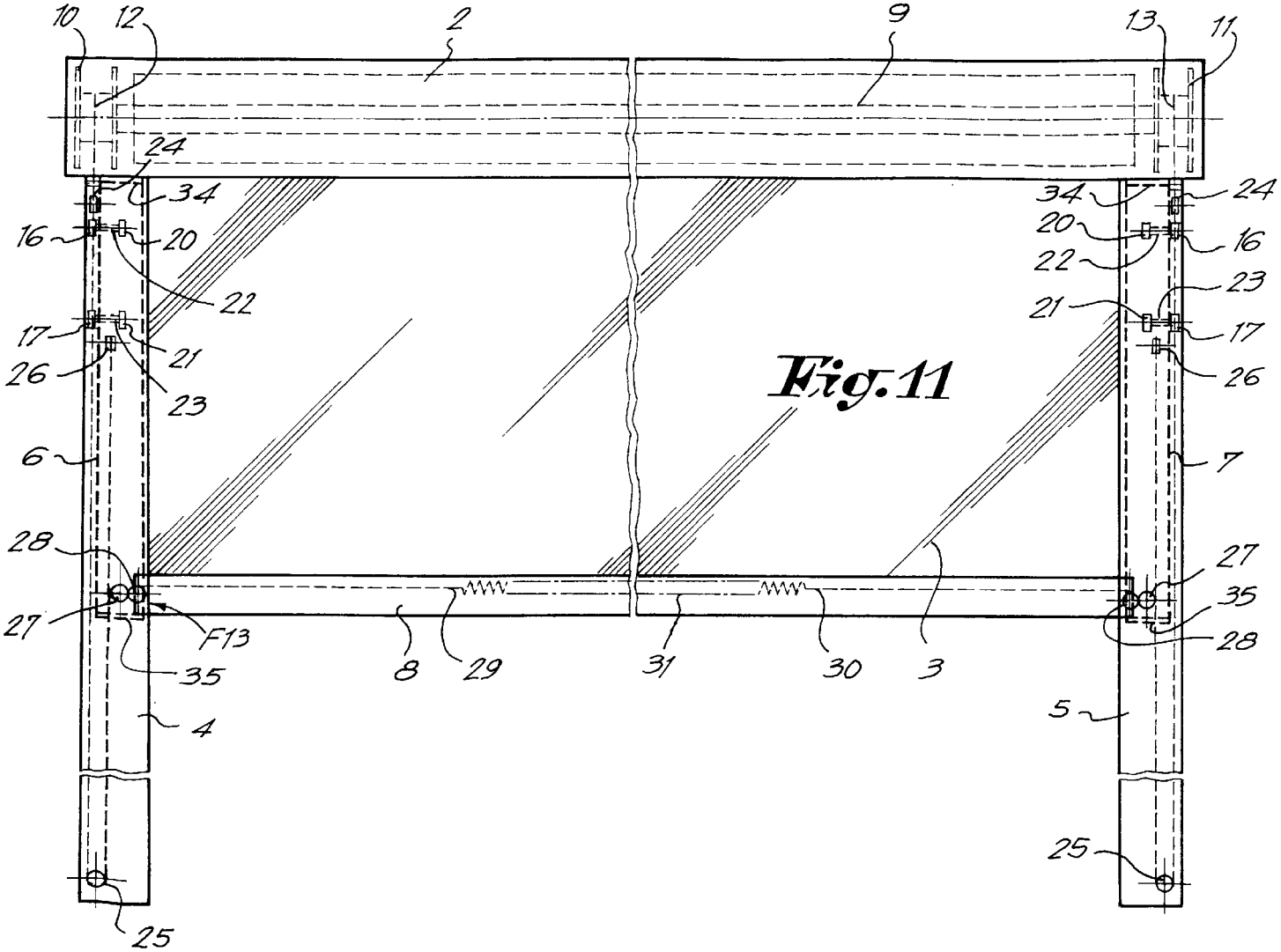
FIG. 11 represents a top view similar to that of FIG. 3, however, with the tent cloth in an intermediate position.

When the tent cloth 3 has to be unwound according to arrow P in FIG. 4, the shaft 9 has to be driven counterclockwise in this FIG. 4, in other words, according to arrow Pl.

This has as a consequence that the cables 12 and 13 will be wound onto the rolls 10 and 11 according to P2, whereby these cables, so to say, exert a tension upon the pulleys 28 in the deployment lath 8, thereby moving this deployment lath 8 in the interior guides 6–7.

Figure 12:
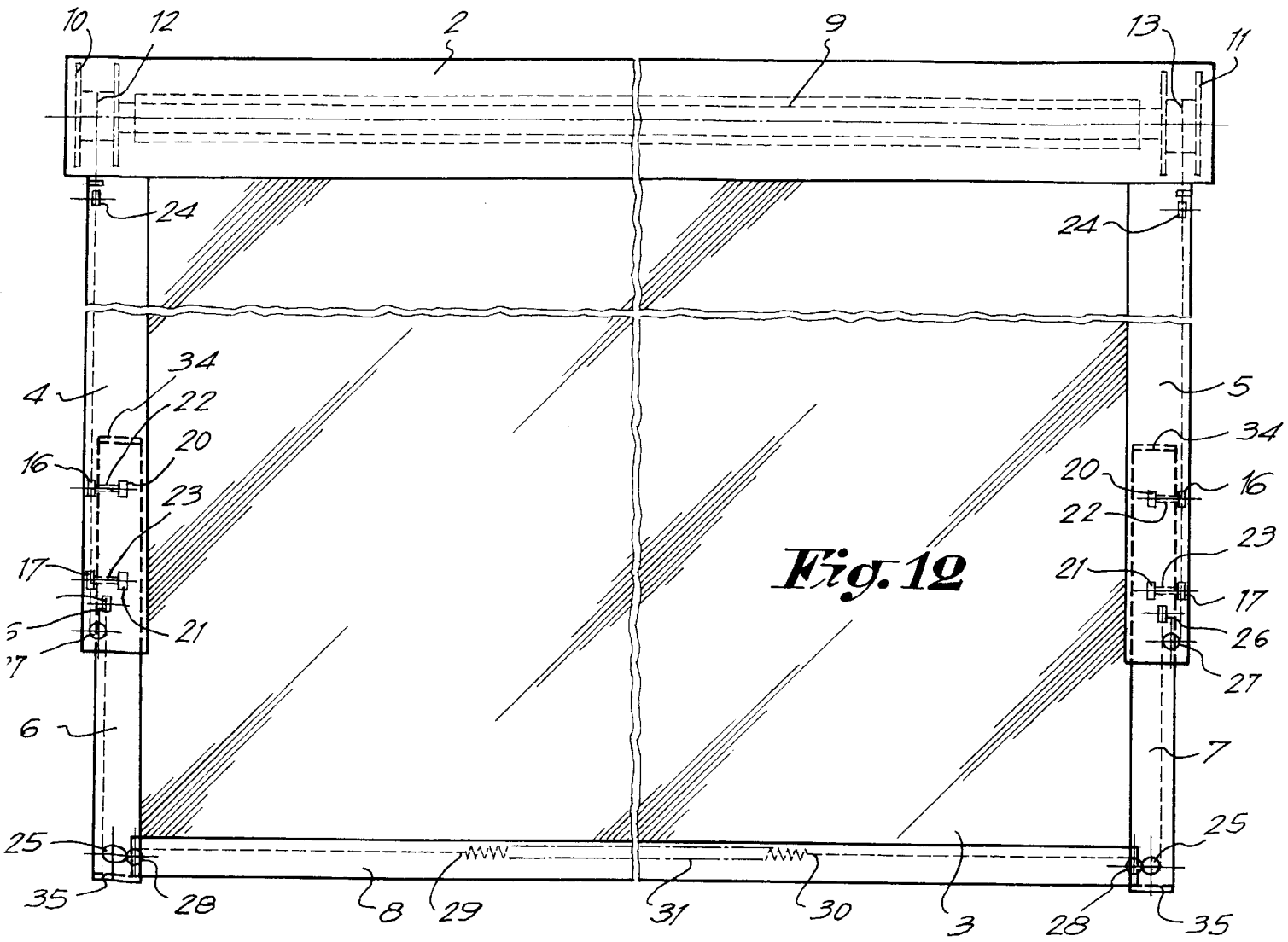
FIG. 12 represents a top view similar to that of FIGS. 3 and 11, however, with the cloth tent in the completely unwound position.

When the deployment lath 8, with its protrusions 32, touches the abutment wall 35 of the interior guides 6–7, at a certain moment the resistance of the pins 37 in the exterior guides 4 and 5 shall be overcome, as a result of which the protrusions 36 at the interior guides 6–7 shall push the pins 37 inwards and thereby shall move alongside these pins 37, in such a manner that the interior guides 6 and 7 move, by means of the wheels 16–17 and 20–21, in the exterior guides 4–5 in order to finally protrude over rather a large part out of these latter guides, as indicated in FIGS. 2 and 12, in order to elongate, so to say, the exterior guides 4 and 5.

The extension of the interior guides 6 and 7 beyond the exterior guides 4 and 5 is stopped by either exactly determining the length of the cloth 3, by providing appropriate abutments, not represented in the drawings, between the interior guides 6–7 and the exterior guides 4–5, or still by means of electric contacts actuated by the cloth 3.

It is obvious that, in this manner, it is obtained that, for example, in the case of a veranda as shown in FIGS. 1 and 2, the cloth 3 can be brought beyond the lower edge of the veranda in a simple manner.

In order to rewind the cloth 3, it suffices to drive the shaft 9 in clockwise direction in FIG. 4, as a result of which the cloth 3 is pulling at the deployment lath 8 and this latter is taking along the interior guides 6–7.

In this way, it is obtained that the extensions of the exterior guides 4 and 5, formed by the interior guides 6 and 7, disappear in the exterior guides when the cloth 3 is wound up.

During all these movements of the cloth 3, the spring 31 will compensate the successive differences in diameter of the quantity of cloth 3 in respect to the rolls 10 and 11.

Figure 13:
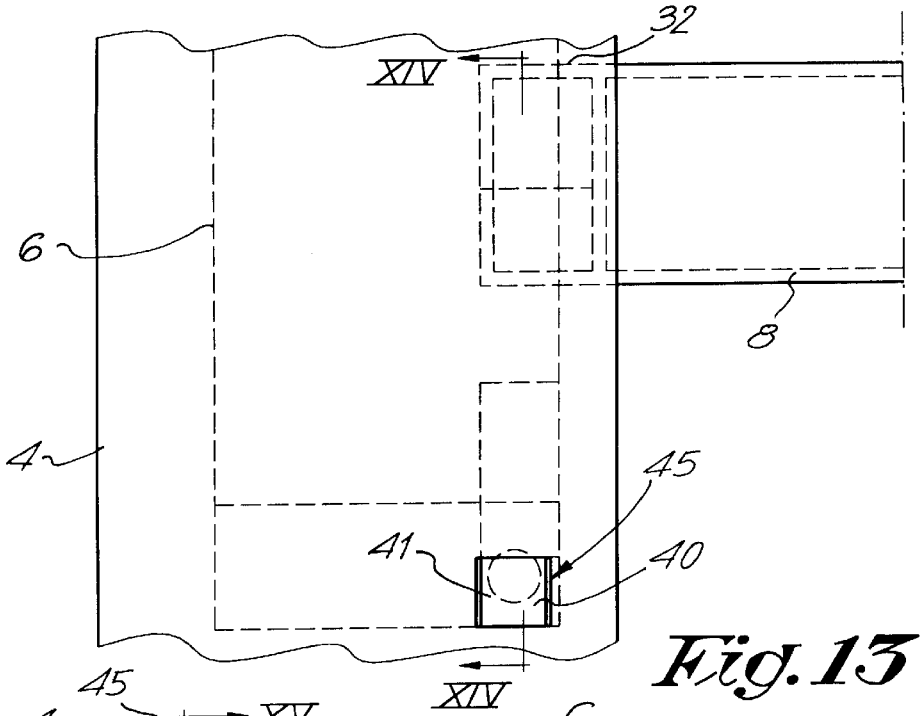
FIGS. 13 to 15 represent an alternative embodiment for a connection between the interior guide and the exterior guide according to the invention.
Figure 14:
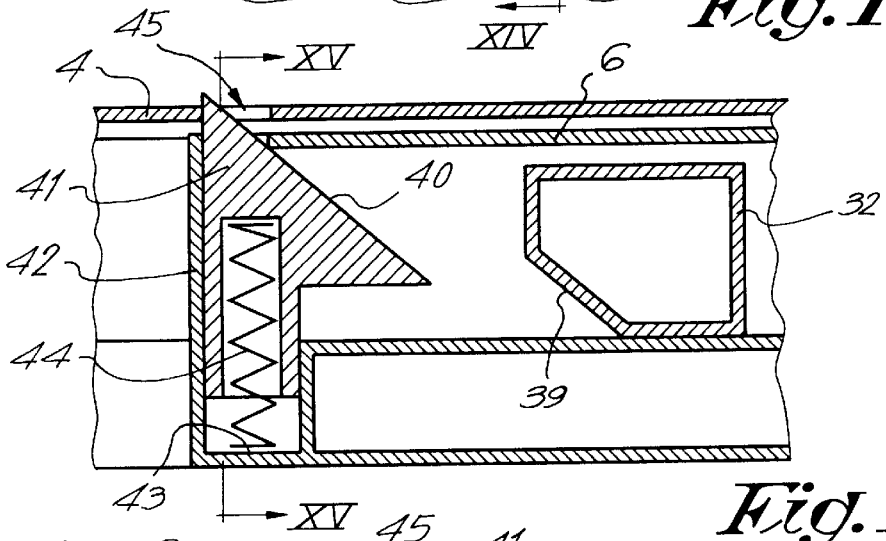
Figure 15:
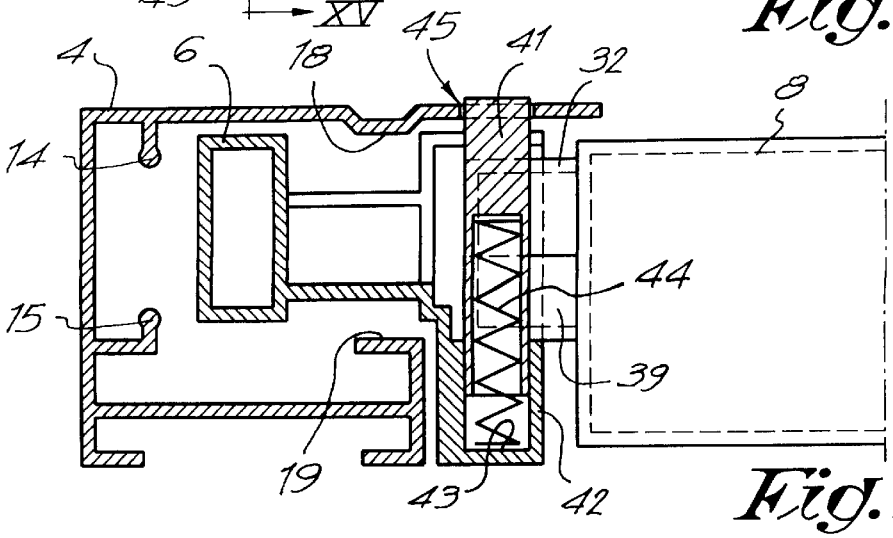

In FIGS. 13 to 15, an alternative embodiment of a locking between the interior guides 6–7 and the exterior guides 4–5 is shown.

Hereby, the protrusions 32 of the deployment lath 8 have an inclined surface 39 which can cooperate with the inclined surface 40 of a locking element 41 which can be shifted in a substantially transverse guide 42 which is provided at the lower free extremity of each interior guide 6–7.

In this guide 42, there is an abutment 43 provided for a spring 44 which permanently pushes the locking element 41 into the locked position, whereby in this latter position it cooperates with an opening 45 in the exterior guides 4–5.

In this alternative embodiment, when the veranda tent is opened, the interior guides 6–7 will remain locked in the exterior guides 4–5 until the protrusions 32 of the deployment lath 8 remove the locking elements 41 from the openings 45, by means of the cooperation of the inclined surfaces 39–40.

It is clear that the present invention is in no way limited to the form of embodiment described by way of example and shown in the accompanying drawings, but that such improved veranda tent can be realized in a variety of forms and dimensions without leaving the scope of the invention.

I claim:

1. An improved veranda tent of the type including a tent cloth (3) carried by a deployment lath (8) and a winding and unwinding mechanism provided in a top casing (2), comprising:

two-part guides formed by fixed guides (4–5) and movable guides (6–7), the movable guides (6–7) being movable in a lengthwise direction with respect to the fixed guides (4–5) and the deployment lath (8) being movable with respect to and with the movable guides (6–7) such that the deployment lath (8) is moved via the two-part guides.

2. The improved veranda tent according to claim 1, wherein the deployment lath (8) has extremities which are movable in the movable guides (6–7).

3. The improved veranda tent according to claim 1, wherein the fixed guides (4–5) comprise exterior guides.

4. The improved veranda tent according to claim 1, wherein the movable guides (6–7) comprise interior guides.

5. The improved veranda tent according to claim 1, wherein the movable guides (6–7) are arranged in a telescopic manner with respect to the fixed guides (4–5).

6. The improved veranda tent according to claim 1, wherein each of the fixed guides (4–5) is formed by a substantially U-shaped profile having an open side, the open sides of the fixed guides (4–5) being directed towards each other.

7. The improved veranda tent according to claim 1, further comprising:

a veranda upon which the veranda tent is mounted, the veranda having a depth;

wherein the fixed guides (4–5) have a length which is equal to the depth of the veranda.

8. The improved veranda tent according to claim 1, wherein each of the movable guides (6–7) is formed by a substantially T-shaped profile having a space (33) formed on a bottom side thereof, the T-shaped profiles being substantially rotated 90° such that the bottom sides thereof are directed towards each other.

9. The improved veranda tent according to claim 8, wherein the movable guides (6–7) include shafts (22–23) on which rollers (16–17) and guide wheels (20–21) are mounted by which the movable guides (6–7) being movable in the lengthwise direction with respect to the fixed guides (4–5) via the rollers (16–17) and the guide wheels (20–21).

10. The improved veranda tent according to claim 9, wherein the rollers (16–17) have a diabolo shape.

11. The improved veranda tent according to claim 9, further comprising:

rails (14–15) arranged in the fixed guides (4–5) such that the rollers (16–17) cooperate therewith.

12. The improved veranda tent according to claim 8, wherein the deployment lath (8) has extremities or protrusions (32) which are situated in the spaces (33) of the movable guides (6–7).

13. The improved veranda tent according to claim 11, further comprising:

an abutment (34–35) respectively provided at each extremity of each of the movable guides (6–7).

14. The improved veranda tent according to claim 13, wherein each of the abutments (34–35) is formed by a wall closing at least the spaces (33) of the movable guides (6–7).

15. The improved veranda tent according to claim 13, wherein each of the abutments is formed by a pin-like structure.

16. The improved veranda tent according to claim 1, further comprising:

a protrusion (36) provided on each of the movable guides (6–7);

a pin (37) provided in each of the fixed guides (4–5); and a spring (38) associated with each of the pins (37) which biases a respective one of the pins (37) so as to cooperate with a respective one of the protrusions (36) on the movable guides (6–7).

17. The improved veranda tent according to claim 16, wherein the pins (37) and the protrusions (36) each have a triangular shape at least at an extremity thereof.

18. The improved veranda tent according to claim 12, further comprising:

at least one locking element (41) having an inclined surface (40);

wherein at least one of the protrusions (32) of the deployment latch (8) has an inclined surface (39) which is arranged to cooperate with the inclined surface (40) of the locking element (41).

19. The improved veranda tent according to claim 18, further comprising:

a substantially transverse guide (42) provided at a lower free extremity of at least one of the movable guides (6–7);

wherein the locking element (41) is shiftable in the transverse guide (42).

20. The improved veranda tent according to claim 19, further comprising:

an opening (45) formed in at least one of the fixed guides (4–5);

an abutment (43) in the at least one transverse guide (42); and a spring (44) which cooperates with the abutment (43) so as to bias the locking element (41) into the opening (45).

21. The improved veranda tent according to claim 1, further comprising:

a driving shaft (9) on which the tent cloth (3) is rolled;

a pair of reels (10–11) mounted on the driving shaft (9) with one of the reels (10–11) located towards each extremity thereof;

a plurality of pulleys (24, 25, 26, 27, 28);

a pair of cables (12–13) which are respectively connected to the pair of reels (10–11), guided over the plurality of pulleys (24, 25, 26, 27, 28) and extended into the deployment lath (8) so that extremities (29–30) of the cables (12–13) are disposed in the deployment lath (8); and a tension spring (31) which connects the extremities (29–30) of the cables (12–13) together.

22. The improved veranda tent according to claim 21, wherein the plurality of pulleys (24, 25, 26, 27, 28) comprises:

first and second pulleys (24–25) freely rotatably attached to each of the fixed guides (4–5);

third and fourth pulleys (26–27) freely rotatably attached to each of the movable guides (6–7); and fifth and sixth pulleys (28) freely rotatably attached to the deployment lath (8).

23. The improved veranda tent according to claim 22, wherein the second pulleys are located at a lower free extremity of each of the fixed guides (4–5) and the fourth pulleys are located at a lower free extremity of each of the movable guides (6–7).

24. The improved veranda tent according to claim 22, wherein the third pulleys (26) are located at a distance from a lower free extremity of each of the movable guides (6–7), the distance being greater than a desired length of the movable guides (6–7) which is extendable beyond the fixed guides (4–5).

* * * * *